US012729548B2

(12) United States Patent
Brinkmann

(10) Patent No.: US 12,729,548 B2
(45) Date of Patent: Sep. 8, 2026

(54) FOLDING RAIL ASSEMBLY, COMBINATION OF FOLDING RAIL ASSEMBLY AND STANDARD, SCAFFOLDING SYSTEM, AND METHOD

(71) Applicant: Scafom Holding B.V., Budel (NL)

(72) Inventor: Franciscus Jozef Leonardus Hubertus Brinkmann, Lierop (NL)

(73) Assignee: Scafom Holding B.V., Budel (NL)

( * ) Notice: Subject to any disclaimer, the term of this patent is extended or adjusted under 35 U.S.C. 154(b) by 282 days.

(21) Appl. No.: 18/580,910

(22) PCT Filed: Jul. 19, 2022

(86) PCT No.: PCT/NL2022/050423
§ 371 (c)(1),
(2) Date: Jan. 19, 2024

(87) PCT Pub. No.: WO2023/003462
PCT Pub. Date: Jan. 26, 2023

(65) Prior Publication Data

US 2024/0344339 A1 Oct. 17, 2024

(30) Foreign Application Priority Data

Jul. 20, 2021 (NL) ..... 2028793

(51) Int. Cl.
*E04G 7/30* (2006.01)
*E04G 5/14* (2006.01)
(Continued)

(52) U.S. Cl.
CPC ..... *E04G 5/142* (2013.01); *E04G 7/303* (2013.01); *E04G 7/34* (2013.01)

(58) Field of Classification Search
CPC ..... E04G 5/142; E04G 7/303; E04G 7/302; E04G 7/307; E04G 7/304; E04G 7/22; A04G 7/34
See application file for complete search history.

(56) References Cited

U.S. PATENT DOCUMENTS

2004/0163889 A1* 8/2004 Wallther ..... E04G 5/142 182/113
2018/0148942 A1* 5/2018 Lindberg ..... E04G 7/32

FOREIGN PATENT DOCUMENTS

CN 106715810 A 5/2017
CN 211899518 U 11/2020
(Continued)

OTHER PUBLICATIONS

International Search Report and Written Opinion—PCT/NL2022/050423—mailing date Jan. 26, 2023.

*Primary Examiner* — Kristen C Hayes
(74) *Attorney, Agent, or Firm* — Banner & Witcoff, Ltd.

(57) ABSTRACT

Folding rail assembly for a scaffold, comprising an upper rail part, a middle rail part, a first post, and a second post which are mutually hingedly connected for adjusting between a folded-in configuration and a folded-out configuration. The first post is provided with a coupling hook structure to suspend the first post from a rosette of a standard of the scaffold in an opening of the rosette with play. At the coupling hook structure a locking hook structure is provided which is configured for, depending on a rotation position of the locking hook structure relative to the rosette, counteracting the first post, by moving up, being brought out of its state suspended from the rosette. By rotation of the rail assembly around a rotation axis parallel to the standard, the locking hook structure can be brought in a locking position to counteract the suspended post coming loose.

20 Claims, 10 Drawing Sheets

(51) Int. Cl.
*E04G 7/22* (2006.01)
*E04G 7/34* (2006.01)

(56) References Cited

FOREIGN PATENT DOCUMENTS

| | | | | | |
|---|---|---|---|---|---|
| DE | 29808393 | U1 | | 8/1998 | |
| DE | 202017100985 | U1 | | 6/2017 | |
| DE | 102017007131 | A1 | | 1/2019 | |
| DE | 102017216889 | A1 | * | 3/2019 | ..... E04G 5/16 |
| DE | 102021101768 | A1 | * | 7/2022 | ..... E04G 1/06 |
| EP | 1650377 | A2 | | 4/2006 | |
| EP | 3670785 | A1 | * | 6/2020 | ..... E04G 7/34 |
| EP | 3916172 | A1 | * | 12/2021 | ..... E04G 5/142 |
| JP | 2017008516 | A | | 1/2017 | |
| JP | 2019015125 | A | | 1/2019 | |
| JP | 6591215 | B2 | * | 10/2019 | ..... E04G 5/14 |
| WO | WO-2015033278 | A1 | * | 3/2015 | ..... E04G 5/147 |
| WO | 2020192811 | A1 | | 10/2020 | |

* cited by examiner

FOLDING RAIL ASSEMBLY, COMBINATION OF FOLDING RAIL ASSEMBLY AND STANDARD, SCAFFOLDING SYSTEM, AND METHOD

CROSS-REFERENCE TO RELATED APPLICATIONS

This application is a U.S. National Stage application under 35 U.S.C. § 371 of International Application PCT/NL2022/050423 (published as WO 2023/003462 A1), filed Jul. 19, 2022, which claims the benefit of priority to Application NL 2028793, filed Jul. 20, 2021. Benefit of the filing date of these prior applications is hereby claimed. Each of these prior applications is hereby incorporated by reference in its entirety.

FIELD

The invention relates to a folding rail assembly for a scaffold, and also to a combination of such a rail assembly and a standard for a scaffold. Further, the invention relates to a scaffolding system, and to a method for fastening a folding rail assembly to standards of a scaffolding system.

BACKGROUND

In a previously filed patent application in the Netherlands having application number NL2027056, a rail assembly for a scaffold is described. The rail assembly described can be adjusted between on the one hand a rail forming configuration, that is, an unfolded or folded-out configuration, and on the other hand a transport configuration, that is, a folded or folded-in configuration. Thus, the rail assembly described can be called a folding rail assembly.

More generally, folding rail assemblies for scaffolds are known per se. There remains an ongoing need for further and yet further improvements in the field of rail assemblies for scaffolds, in particular so as to be able to furnish for diverse types of scaffolds a fall protection solution that is optimal in efficiency and effectiveness.

SUMMARY

An object of the present invention is to provide an improved solution for fall protection for a scaffold whose standards are provided with rosettes. To the rosettes, for example ledgers or other scaffold parts can be coupled. Such standards with rosettes are generally known per se and are widely used in scaffolding. The scaffolding systems concerned are also called ring scaffold systems.

More particularly, an object is to provide for such a scaffolding system a rail assembly which can be fastened particularly easily and safely from a lower scaffold level relative to the scaffold level for which the fastened rail assembly is to provide fall protection.

To that end, the invention provides a folding rail assembly according to claim 1 for a scaffold. The folding rail assembly comprises: an upper rail part which extends in a length direction between a respective first end and a respective second end; a middle rail part which extends in a length direction between a respective first end and a respective second end; a first post which is hingedly connected with each of the respective first ends of the upper rail part and the middle rail part; and a second post which is hingedly connected with each of the respective second ends of the upper rail part and the middle rail part.

By means of hinging of the hingeable connections, the folding rail assembly is adjustable between a folded-in configuration and a folded-out configuration.

The first post is provided with a coupling hook structure which is configured to suspend the first post from a rosette of a standard of the scaffold when the first post is positioned substantially parallel to the standard. The coupling hook structure is configured to be received with play in an opening of the rosette so as, in a state suspended from the rosette, to be rotatable relative to the rosette around a rotation axis which extends substantially parallel to the standard.

The first post is provided, at the coupling hook structure, with a locking hook structure. The locking hook structure is configured, depending on a rotation position of the coupling hook structure relative to the rosette around the rotation axis, to counteract the first post, by moving up, being brought out of its state suspended from the rosette.

The combination of the coupling hook structure and the locking hook structure advantageously enables coupling of the first post near an intended rail position along the standard to the standard by suspension and locking of that coupling, in particular by a person who is at a lower scaffold level. By keeping the folding rail assembly during suspending in a folded state, the rail parts can be effectively used to position the first post from a distance, so that the first post can be suspended from a rosette at the height of an upper scaffold level. In particular, thus, at a distance, first the coupling hook structure can be hooked into an opening of the rosette by a substantially vertical movement, after which the rail assembly can be turned about a substantially vertical axis to bring the locking hook structure in a locking position, while these movements can each be carried out from a lower scaffold level by a person present there.

Because the coupling position can thus be located near an intended rail position, the length of the first post can be relatively short, being for instance substantially correspondent to a distance between two successive rosettes along the standard. Due to this relatively short length of the first post, not only material is saved but also the folding rail assembly can be particularly lightweight and particularly compact, which further augments its ease of handling and hence the ease of its fastening to the scaffold. At the same time, a particularly reliable coupling between rail assembly and standard is provided, which eventually promotes a good fall protection.

As is further explained hereinbelow in the context of a related method, the rail assembly, after suspension of the first post, can be folded out, whereupon the second post can be coupled to a further standard of the scaffold to complete the fastening of the rail assembly to the scaffold, and hence the realization of an effective rail on the scaffold.

According to a further aspect, there is provided a combination of the herein described folding rail assembly and a standard for a scaffold, the standard being provided with a rosette having an opening for therein receiving with play the coupling hook structure of the folding rail assembly.

With such a combination the above-mentioned advantages can be provided. The standard with rosette can be of a type known per se, so that the herein described folding rail assembly can be advantageously used in combination with already available scaffolding systems with such standards.

According to a further aspect, a scaffolding system is provided, comprising the herein described combination of the folding rail assembly and the standard. The scaffolding system can comprise further scaffold parts, for example ledgers and floor parts.

Thus, a known-per-se scaffolding system with standards having rosettes can be expanded or adapted to include the herein described rail assembly, for instance as an alternative to or addition to any other form of fall protection for the scaffolding system.

According to a further aspect, a method is provided for fastening a rail assembly to a scaffold which comprises a standard which is provided with a rosette. The method comprises: providing a herein described folding rail assembly; hooking the coupling hook structure into an opening of the rosette of the standard while the first post is positioned substantially parallel to the standard, as a result of which the first post is suspended from the rosette; rotating the coupling hook structure relative to the rosette around a rotation axis which extends substantially parallel to the standard, as a result of which the locking hook structure is positioned to counteract the first post relative to the rosette, by moving up, being brought out of its state suspended from the rosette; and at a distance from the standard, additionally coupling the folding rail assembly to the scaffold, as a result of which further rotation of the coupling hook structure relative to the rosette around the rotation axis is counteracted.

With such a method, the above-mentioned advantages are achieved. As already indicated hereinabove, with such a method, in a particularly easy and reliable manner, a fall protection in the form of a rail can be realized for an upper scaffold level, while the person who is fastening the rail assembly to the scaffold can continue to stay on the lower scaffold level. In that regard, the rail parts can be used to position the first post, which can be relatively short, above a range of hand of the person mentioned, first to suspend the coupling hook structure from the rosette and then, by a rotation movement, to bring about a locking. The thus obtained locking can, after folding out of the rail assembly, be secured by coupling the second post to the further standard.

The second post is preferably longer than the first post, at least, long enough to be manually grasped from the lower scaffold level. Alternatively or additionally, possibly, for instance a push rod or a like aid may be used to position the second post.

When the second post is coupled to the standard at the height of the lower scaffold level, for instance as an addition to a coupling at the height of the rail parts, this can advantageously counteract the rail assembly being detached from the scaffold from the scaffold level for which the assembly provides a fall protection. The second post, however, can still be easily uncoupled, from the lower scaffold level, for instance to fold the rail assembly to provide a temporary passage through the scaffold or to dismantle the scaffold.

Further advantageous elaborations of the invention are provided by the features of the dependent claims, as further explained in the following detailed description.

DETAILED DESCRIPTION

In the following, the invention will be further explained on the basis of examples of embodiments and drawings. The drawings are schematic and merely show examples. In the drawings, like or corresponding elements are denoted with like or corresponding reference signs. In the drawings.

Figure 1A:
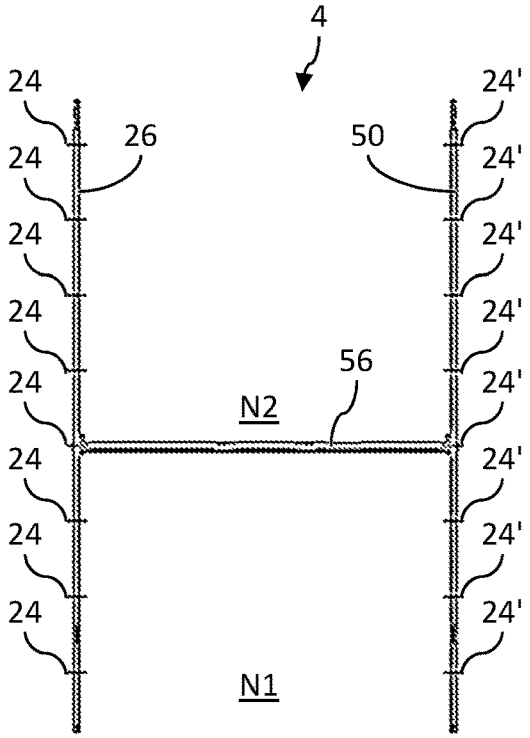
FIG. 1A shows a front view of a scaffold.

FIG. 1A shows a schematic front view of an example of a scaffold 4, here comprising a standard 26 and a further standard 50 which are mutually connected by a lying part such as a ledger with a floor part 56. The floor part 56 here provides a gangway on an upper or second scaffold level N2, which is located above a lower or first scaffold level N1. The lower scaffold level N1 may also be provided with a respective floor part (not shown).

On each of the standards 26 and 50, at regular intervals along the length direction of the standard, rosettes 24 and 24' are provided here, to which scaffold parts such as a ledger for the floor part 56 can be coupled. Such scaffolds or scaffolding systems with standards having rosettes are known per se and are also called ring scaffolds and ring scaffolding systems, respectively.

Figure 1B:
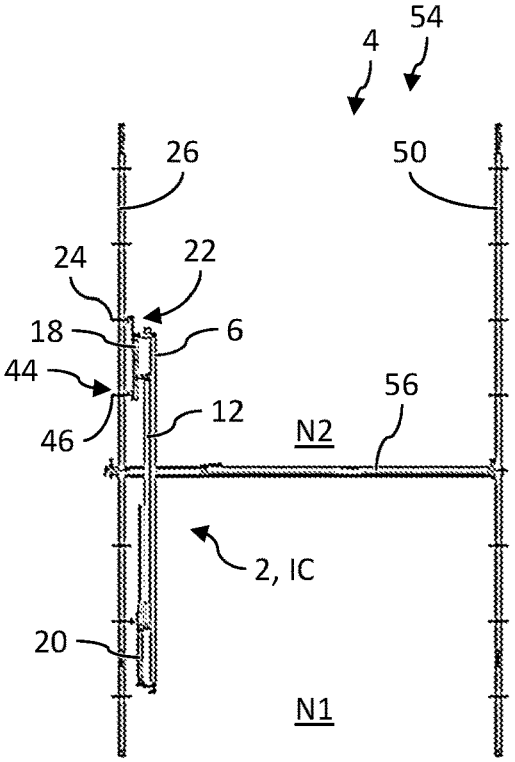
FIG. 1B shows a front view according to FIG. 1A, wherein a first post of a folding rail assembly is suspended from a rosette of a standard of the scaffold, while the rail assembly is in a folded-in configuration.
Figure 1C:
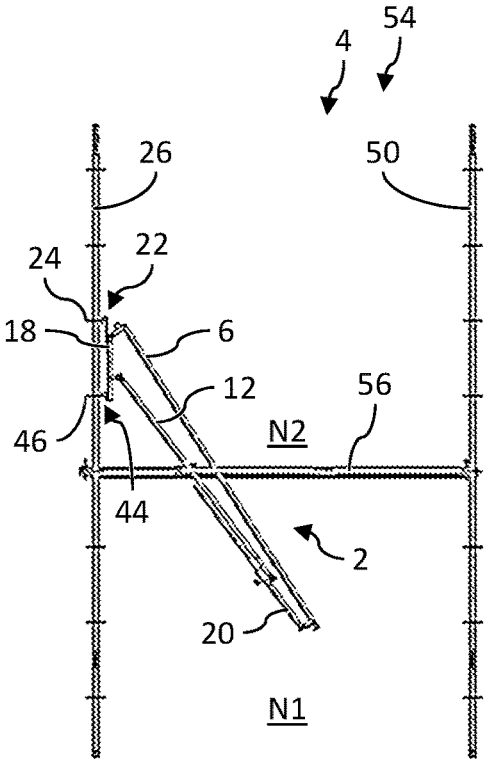
FIG. 1C shows a front view according to FIG. 1B, wherein the folding rail assembly is in a partly folded-out configuration.
Figure 1D:
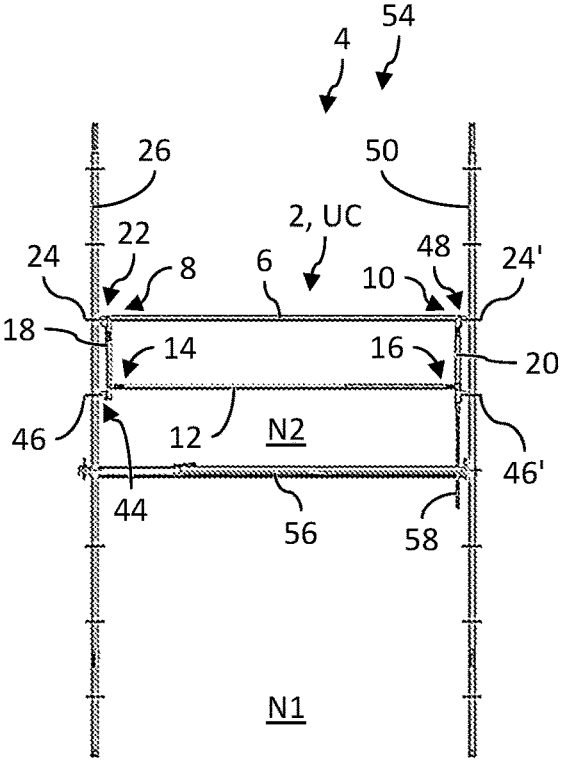
FIG. 1D shows a front view according to FIG. 1C, wherein the folding rail assembly is in a fully folded-out configuration and wherein a second post of the folding rail assembly is coupled to a further standard of the scaffold.

FIGS. 1B-D show the scaffold 4 of FIG. 1A provided with a folding rail assembly 2 in different configurations. The other figures show details of such a folding rail assembly 2 according to various embodiments, likewise in different configurations, and in different rotation positions, as is further explained elsewhere in this description.

The folding rail assembly 2 comprises (see for example FIG. 1D): an upper rail part 6 which extends in a length direction between a respective first end 8 and a respective second end 10; a middle rail part 12 which extends in a length direction between a respective first end 14 and a respective second end 16; a first post 18 which is hingedly connected with each of the respective first ends 8, 14 of the upper rail part 6 and the middle rail part 12; and a second post 20 which is hingedly connected with each of the respective second ends 10, 16 of the upper rail part 6 and the middle rail part 12.

The folding rail assembly 2 is adjustable by means of hinging of the hingeable connections between a folded-in configuration IC (see FIGS. 1B, 2A-B, 4A-B, 5B, 7A) and a folded-out configuration UC (see FIGS. 1D, 3A-B, 6A). FIG. 1C shows the folding rail assembly 2 of FIGS. 1B and 1D in an intermediate configuration, that is, a partly folded-in or partly folded-out configuration. The folded configuration IC can be regarded as a transport configuration, in which the assembly 2 can be transported easily and compactly. The unfolded configuration UC can be regarded as a rail forming configuration, in which the assembly 2 can form an effective scaffold rail for fall protection.

The first post 18 is provided with a coupling hook structure 22 which is configured to suspend the first post 18 from a rosette 24 of a standard 26 of the scaffold 4 when the first post 18 is positioned substantially parallel to the standard 26.

The coupling hook structure 22 is configured to be received with play in an opening 28; 30 of the rosette 24 so as, in a state suspended from the rosette 24, to be rotatable relative to the rosette 24 around a rotation axis R which extends substantially parallel to the standard 26.

The first post 18 is provided at the coupling hook structure 22 with a locking hook structure 32 or 33 which is configured for, depending on a rotation position of the coupling hook structure 22 relative to the rosette 24 around the rotation axis R, counteracting the first post 18, by moving up, being brought out of its state suspended from the rosette 24.

The figures (with the exception of FIG. 1A) each show the folding rail assembly 2 in a state suspended from the rosette 24, but in different rotation positions.

FIGS. 2A-B and 5A-B show the rail assembly 2 in a first rotation position I around the rotation axis R. In the first position I, the locking hook structure 32 or 33 is substantially released relative to, in particular by, the rosette 24, such that any upward moving of the first post 18 is substantially not impeded. Thus, the first rotation position I can be regarded as a release position.

In the first rotation position I the rail assembly 2 can hang substantially within the scaffold 4, so that the assembly 2 can safely and easily be first suspended from the rosette 24 in this first rotation position I, from the lower scaffold level N1.

FIGS. 3A-B and 6A-B show the rail assembly 2 in a second rotation position II around the rotation axis R. In the second rotation position II, the locking hook structure 32 or 33 is substantially locked relative to, in particular by, the rosette 24, such that a moving upwards of the first post 18 is substantially blocked. Thus the second rotation position II can be regarded as a locking position.

In the second rotation position II, the rail parts 6 and 12 of the assembly 2 in the folded-out configuration UC point from the first post 18 to a further standard 50 of the scaffold 4, so that, there, the second post 20 can be coupled to the scaffold 4, for instance to a further standard 50 of the scaffold 4. Such a coupling can advantageously fix the folding rail assembly 2 in its second rotation position II, so that also the locking by the locking hook structure 32 or 33 is thereby secured.

In an embodiment, the rail assembly 2 is, to that end, provided at the second post 20 with a coupling means 48 for, after suspending of the first post 18, coupling the second post 20 to a further standard 50 of the scaffold 4 so as to fix the rail assembly 2 substantially in its folded-out configuration UC to the scaffold 4. The coupling means 48 can comprise, for example, one or more coupling hook structures (see FIG. 8A) for cooperation with one or more rosettes 24', 46' of the further standard 50. Coming loose of the coupling means 48 itself may possibly be counteracted by a respective locking, at least a further coupling, in particular at an end section 58 of the second post 20. The end section 58 may for instance be accessible from the lower scaffold level N1, but not so, or difficultly so, from the upper scaffold level N2. Such an end section 58 can help preventing a person undoing the fall protection by the rail assembly for the scaffold level N2 where such person himself is, and moreover makes it possible to couple or uncouple the coupling means 48 at the level of rail parts 6 and 12 safely and easily from the lower scaffold level N1. The second post 20 may thus be longer than the first post 18. As an alternative to or addition to the longer second post 20, for example a push rod may be provided, which is for instance hingedly connected to the second post 20. Coupling of such a push rod to the scaffold 4, in particular after coupling of the coupling means 48, can then also contribute to locking of the coupling of the coupling means 48 to the scaffold 4.

Figure 8A:
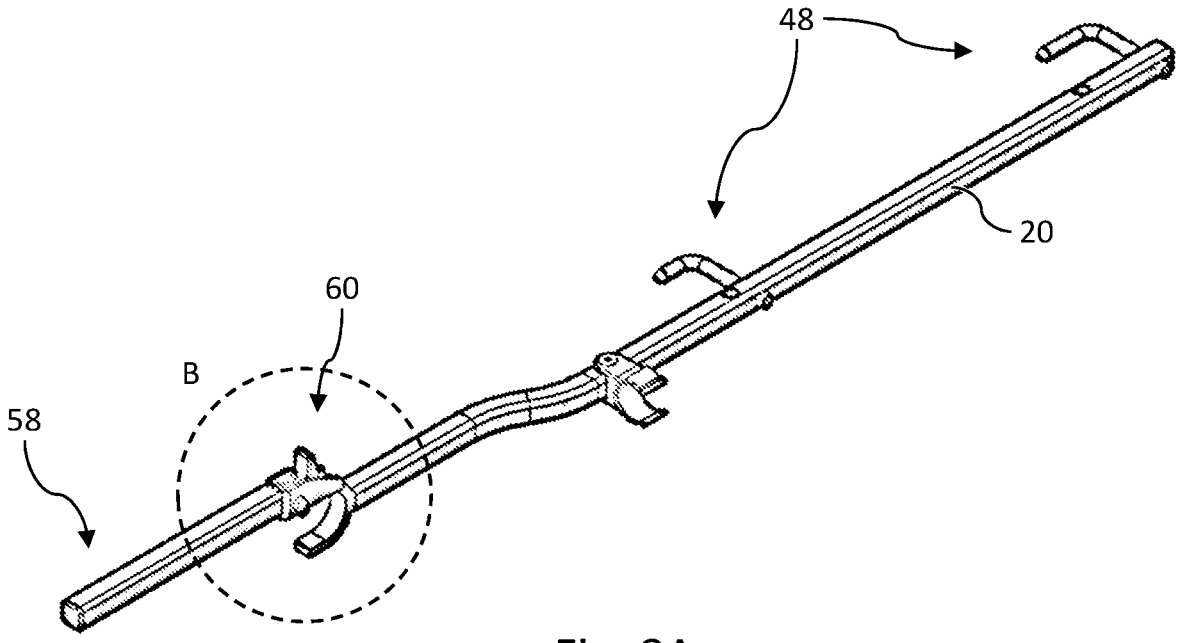
FIG. 8A shows an isometric view of a portion of the rail assembly at the second post, according to an example.
Figure 8B:
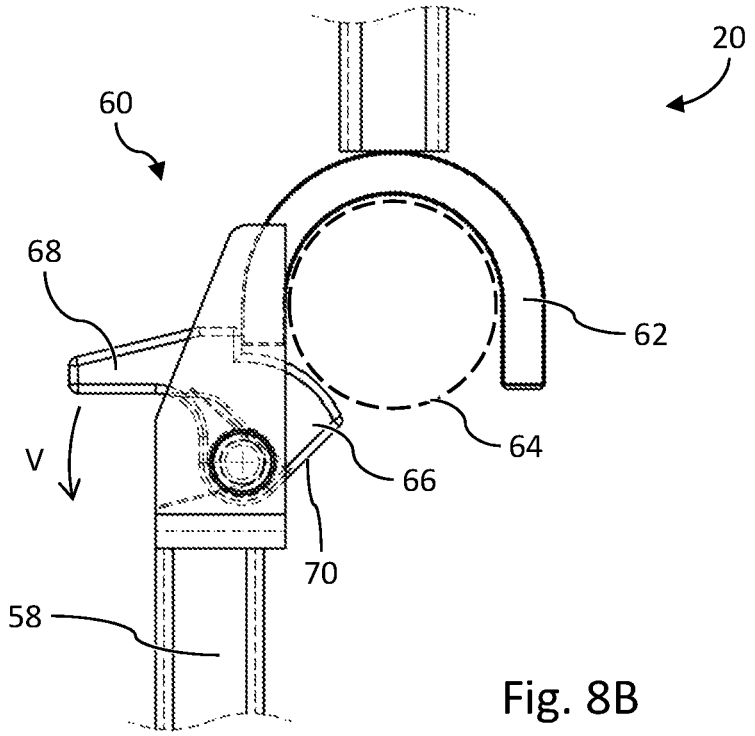
FIG. 8B shows in side view a detail B of FIG. 8A.

FIGS. 8A-B show as an example a possible arrangement of the folding rail assembly at the second post 20. For simplicity of the drawing, the rail parts are not shown in FIG. 8A. It can be seen that near an end section 58 of the second post 20, a locking mechanism 60 is provided. The locking mechanism 60 can comprise a hook 62 which is configured to be supported on a ledger 64 of the scaffold 4, for example a ledger 64 which is associated with a floor part 56 of the scaffold level N2 for which the rail assembly 2 provides fall protection. In FIG. 8B a broken line 64 indicates a position of such a ledger in transversal cross section, in which position the locking mechanism 60 locks the second post 20 to the ledger 64. The locking mechanism 60 can comprise a locking cam 66 which is movable, for example hingeable, relative to the second post 20, in particular relative to the hook 62, between a locking position (see FIG. 8B) and a release position (in the direction of arrow V in FIG. 8B). The locking cam 66 in the locking position shuts-in the ledger 64 in a receiving space of the hook 62 (see FIG. 8B). In the release position, an exit of the ledger 64 out of the receiving space of the hook 62 is allowed. The locking cam 66 is preferably biased, for instance by means of a spring element, in the direction of the locking position, so as to keep the locking cam 66 normally in its locking position. On the locking cam 66 an operating arm 68 or other operating element may be provided to move the locking cam manually, in particular against the bias, from its locking position to its release position, in particular when the second post must be detached from the scaffold. Preferably, the locking cam 66 is further configured such that it can be moved from its normal locking position to its release position by moving a ledger 64 into the receiving space of the hook, in particular against the spring action. To that end, the locking cam 66 is for instance provided with a suitable bevel 70.

Alternatively or additionally, for coupling and/or locking of the end section 58 of the second post 20, or the push rod, to the further standard 50, for example a coupling assembly may be provided on the end section 58 or push rod, which coupling assembly is described in a previously filed patent application in the Netherlands with application number NL2027055. In brief, the coupling assembly described there is configured for coupling a first and a second scaffolding tube in a mutually parallel way, in the context of the present invention for instance a post of a rail assembly and a standard of a scaffold, wherein the coupling assembly comprises a securing unit which under deformation thereof is displaceable relative to a fork and is thereby adjustable between a securing state and a releasing state, wherein the securing unit in the securing state is configured to form a narrowing to secure in the receiving space a second scaffolding tube, wherein the securing unit in the releasing state is configured to form less or no narrowing so that a second scaffolding tube is removable from the receiving space in the fork direction, wherein the securing unit comprises a handgrip which is positioned such that the securing unit under deformation thereof is displaceable relative to the fork by a single combined hand gripping of the handgrip and the first scaffolding tube to thereby adjust the securing unit 20) from the securing state to the releasing state.

An example of a further alternative or addition for locking the end section 58 of the second post 20 to the further standard 50 is shown in FIGS. 9A-B, 10 and 11. In this example, on the end section 58 a hook element 72 is provided which is rotatable relative to the end section 58 about a rotation axis X which is substantially parallel with the upper rail part 6 and the middle rail part 12 in the folded-out configuration UC. The hook element 72 is crank shaped here, having a hook end 74 which extends remote from that rotation axis X, substantially parallel to that rotation axis X. By rotation of the hook element 72 around the rotation axis X, the hook end 74 can be brought under an adjacent rosette 24' of the further standard 50, as a result of which moving up of the second post 20 is counteracted and the end section 58, at least as far as such moving up is concerned, is locked to the further standard 50. The rotation axis X is preferably positioned above the rosette 24' concerned, so that the hook end 74 under its own weight can end up and remain in its locking position under the rosette 24', and so that, accordingly, an active rotation of the hook element 72 by a user is needed to undo or prevent the locking mentioned. It will be clear that the hook element 72 in this example is permanently axially locked to the end section 58 of the second post 20, here in particular by, on the one hand, the shape of the hook element 72 itself and, on the other hand, a locking ring 76.

Figure 9A:
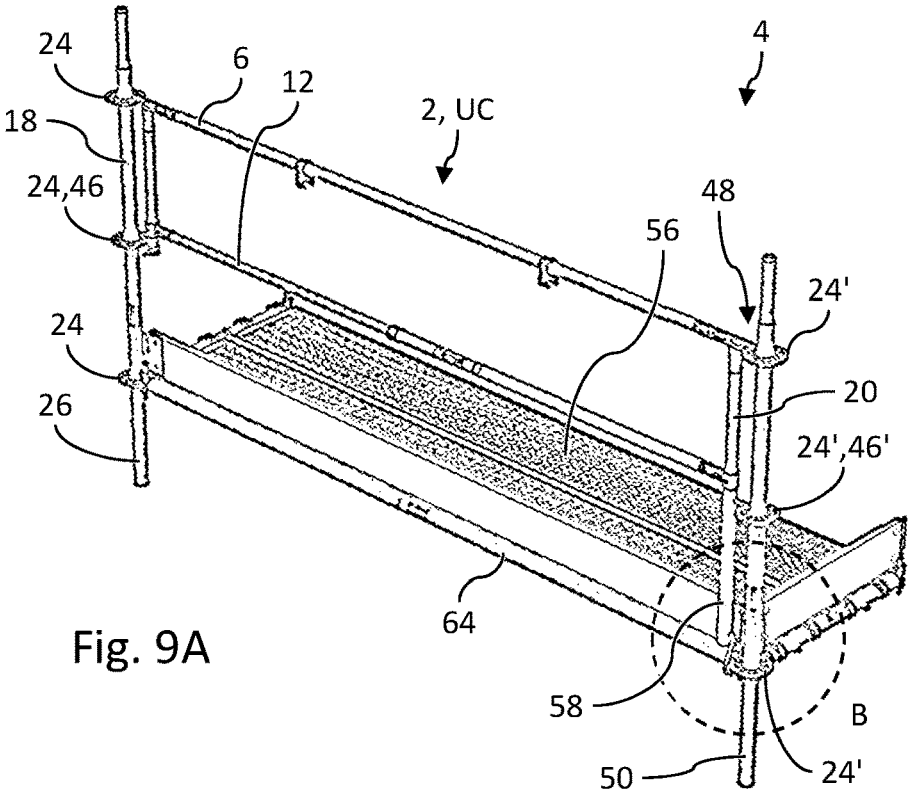
FIG. 9A shows an oblique top view of a portion of a scaffold provided with an example of a folding rail assembly.
Figure 9B:
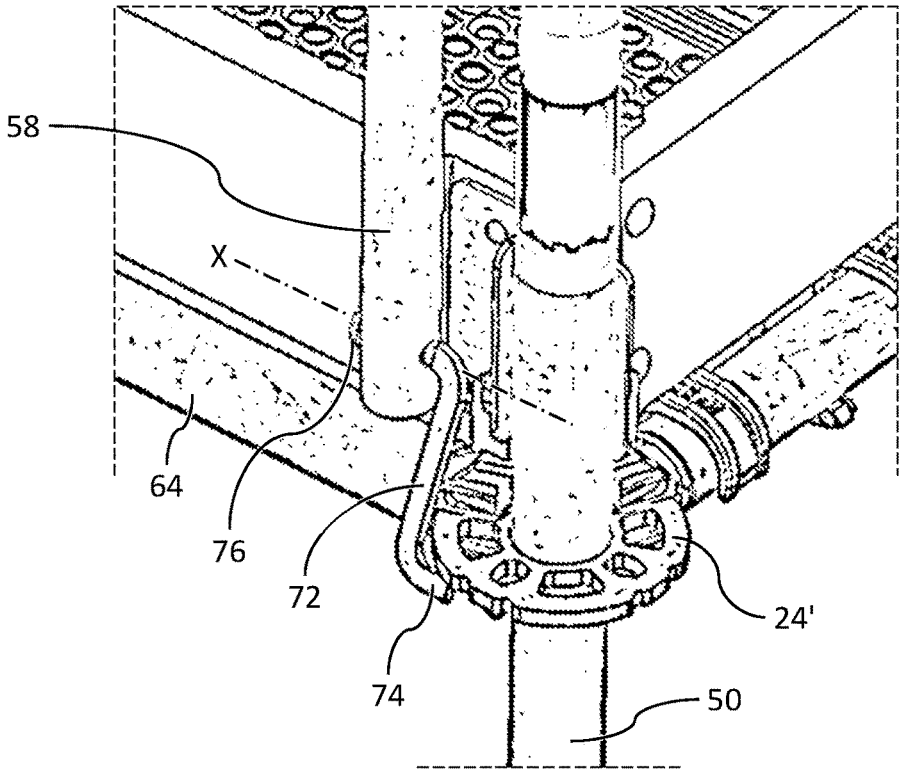
FIG. 9B shows a detail B of FIG. 9A concerning an end section of a second post of the folding rail assembly.
Figure 10:
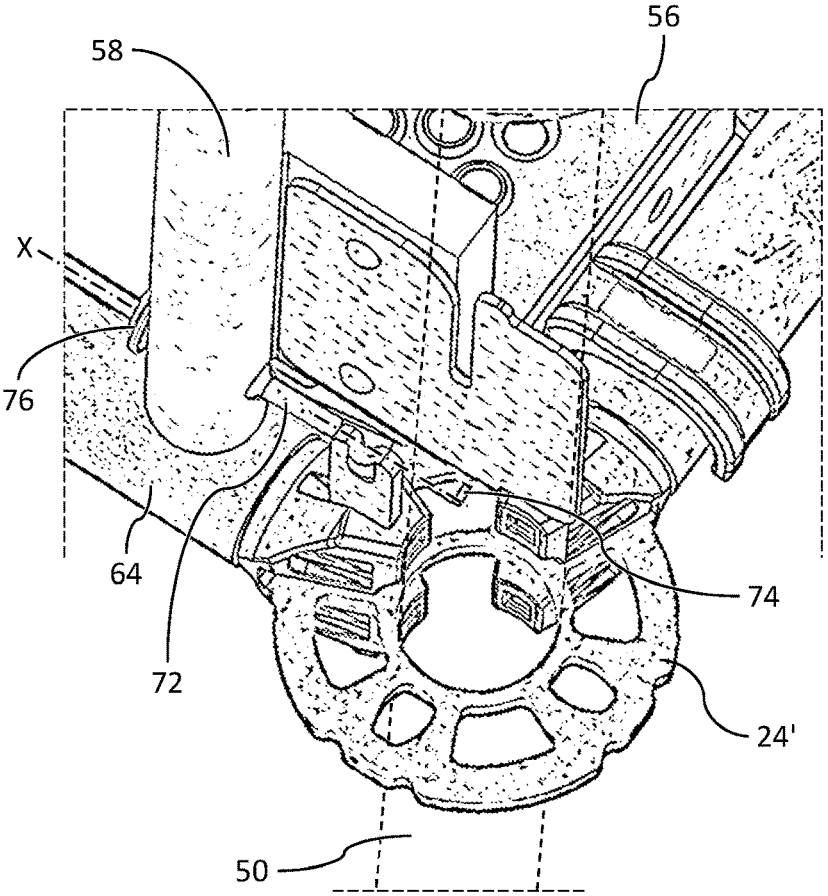
FIG. 10 shows an oblique top view concerning the end section of the second post, wherein compared with FIG. 9B a different locking position is shown.
Figure 11:
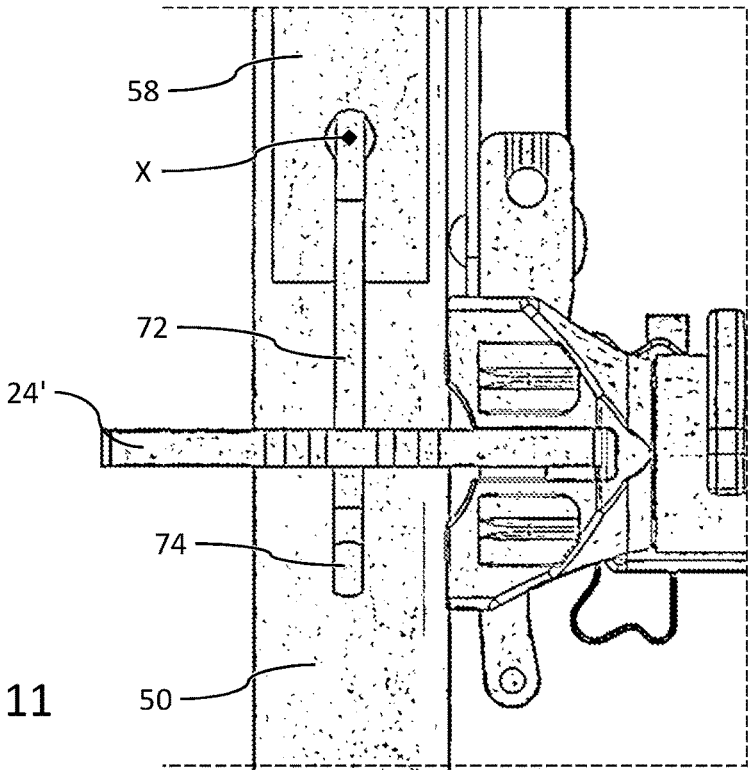
FIG. 11 shows a side view concerning the end section of the second post, wherein compared with FIGS. 9B and 10 yet another locking position is shown.

When FIGS. 9B, 10 and 11 are compared, it can be seen that the hook element 72 can be applied in different locking positions, for instance as desired by a user and/or depending on the further construction of the scaffold. In FIG. 9B the hook element 72 is supported at an outer side of the scaffold 4 on a ledger 64, also called a longitudinal ledger 64, which is coupled to the same rosette 24' as that which the hook end 74 has been hooked under and which extends parallel to the rail parts 6 and 12. In FIG. 10, the hook element 72 is supported at an inner side of the scaffold on that longitudinal ledger 64. The further standard 50 is drawn in transparent view in FIG. 10 to make the hook end 74 located behind it visible. An advantage of the lock position of FIG. 10 is that a stronger protection from unintended coming loose can be provided, because the hook end 74 is less well accessible from the outside and, for instance, may be blocked by a floor part 56. An advantage of the locking position of FIG. 9B is that the rail assembly 2 can be placed and/or removed relatively easily while the floor part 56 mentioned remains in its position.

In FIG. 11, on the rosette 24' which the hook end 74 has been hooked under, no longitudinal ledger such as longitudinal ledger 64 in FIGS. 9B and 10 is provided, which may be desired in some scaffold constructions. It allows the hook element 72 in the situation of FIG. 11 to hang substantially straight down, with the hook end 74 extending at some distance from the rosette 24' under the rosette 24'. Although in this way in the locking position of FIG. 11 some play is possible between the hook end 74 and the rosette 24', still a reliable locking is provided against coming loose of the second post 20. For the play between hook end 74 and rosette 24' is small with respect to a distance over which the second post 20 would have to be moved up to actually come loose from the further standard 50, for instance by a correspondingly sufficiently large hook height of the coupling means 48.

Thus, by a hook element 72 rotatably coupled to the end section 58, with a relatively simple construction a particularly versatile and reliable locking of the end section 58 of the second post 20 relative to the further standard 50 can be provided.

An angle about the rotation axis R between the first rotation position I and the second rotation position II is about 45 degrees in the example of FIGS. 2A-3B and about 90 degrees in the example of FIGS. 5A-6B. More generally, an angle as mentioned can for instance be an angle in the range of 20 degrees through 115 degrees.

FIGS. 4A-B and 7A-B show the rail assembly 2 in a third rotation position III around the rotation axis R. The third rotation position III can be achieved by, after rotation from the first rotation position I to the second rotation position II, rotating the assembly 2 further in the same direction of rotation, for instance by 45 degrees. In this third rotation position III, the rail assembly can hang substantially outside the scaffold 4, with the locking by the locking hook structure 32 or 33 substantially maintained. Thus, in a safe and easy way, for instance a temporary passageway through the scaffold 4 can be created, for instance when goods have to be passed into and out of a building through the scaffold 4.

A method for fastening a rail assembly 2 to a scaffold 4 which comprises a standard 26 which is provided with a rosette 24, comprises: providing the folding rail assembly 2; hooking the coupling hook structure 22 into an opening 28 or 30 of the rosette 24 of the standard 26 while the first post 18 is positioned substantially parallel to the standard 26, as a result of which the first post 18 is suspended from the rosette 24; rotating the coupling hook structure 22 relative to the rosette 24 around a rotation axis R which extends substantially parallel to the standard 26, as a result of which the locking hook structure 32 or 33 is positioned to counteract the first post 18 relative to the rosette 24, by moving up, being brought out of its state suspended from the rosette 24; and at a distance from the standard 26 additionally coupling the folding rail assembly 2 to the scaffold 4, as a result of which further rotation of the coupling hook structure 22 relative to the rosette 24 is counteracted.

In an embodiment, the method further comprises adjusting of the folding rail assembly 2 from the folded-in configuration IC to the folded-out configuration UC after suspending of the first post 18, in particular prior to additionally coupling the assembly 2 to the scaffold 4.

In an embodiment, the first post 18 is provided with a further coupling hook structure 44 which is configured for coupling the first post 18 at a distance from the coupling hook structure 22 to a further rosette 46 of the standard 26.

With such a further coupling hook structure 44, the first post 18 can easily be suspended such that rotation around any other axis than the described rotation axis R is substantially counteracted, so that the rail assembly 2 can easily be firmly attached.

The further coupling hook structure 44 may for instance be shaped correspondingly to the coupling hook structure 22. The further coupling hook structure 44 could be provided with a respective locking hook structure, but that is not necessary.

In an embodiment, at least one of the upper rail part 6 and the middle rail part 12 is telescopably configured to be adjustable in its length.

Thus, the rail assembly 2 can be particularly compact in its folded configuration IC.

In an embodiment of the method, adjusting the folded-in configuration IC to the folded-out configuration UC comprises adjusting the telescopably configured at least one of the upper rail part 6 and the middle rail part 12 in length by telescoping.

For further explanations on the possibilities and advantages of such telescopable rail parts, reference is made to the patent application in the Netherlands having application number NL2027056, mentioned in the background section.

In an embodiment, a hook end section 34 of the coupling hook structure 22 extends substantially parallel to the length direction of the first post 18, with a hook end section 36 or 37 of the locking hook structure 32 or 33 extending at an angle α to the length direction of the first post 18, with the angle α being in the range of 45 through 135 degrees.

Such an angle α makes it possible to readily adjust the hook end section 36 or 37 between a release position, for example the first rotation position I, and a locking position, for example the second rotation position II, by a rotation about a rotation axis R which extends substantially parallel to the first post 18, that is, in this case, a substantially vertical rotation axis R.

Figure 2A:
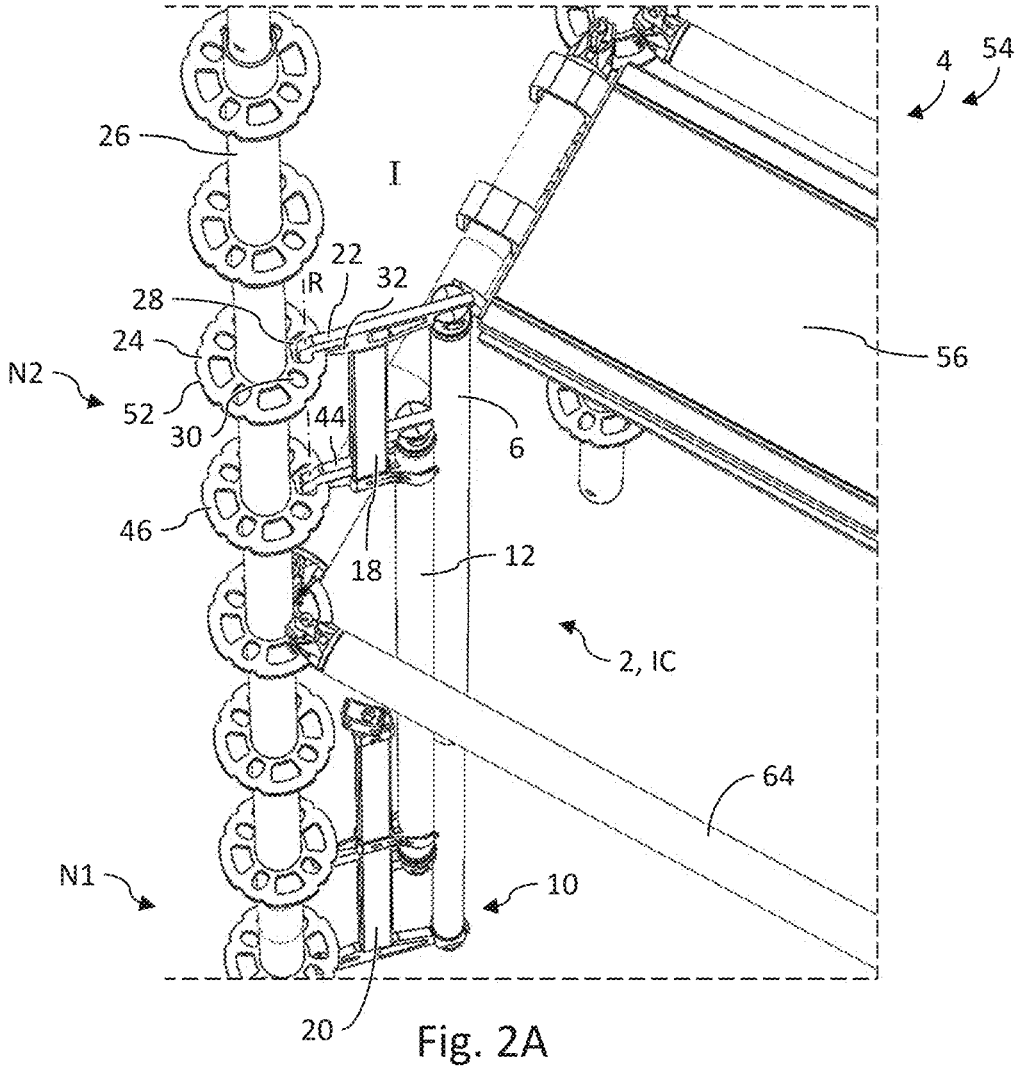
FIG. 2A shows an oblique top view of a combination of an example of a folding rail assembly according to a first embodiment and a standard of a scaffold, wherein a coupling hook structure of the assembly is in a first rotation position relative to a rosette of the standard.
Figure 2B:
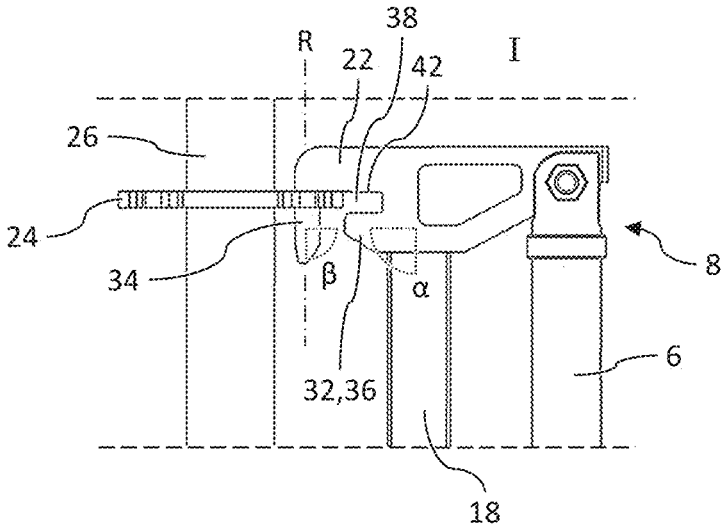
FIG. 2B shows an oblique front view of a detail of the situation of FIG. 2A.
Figure 3A:
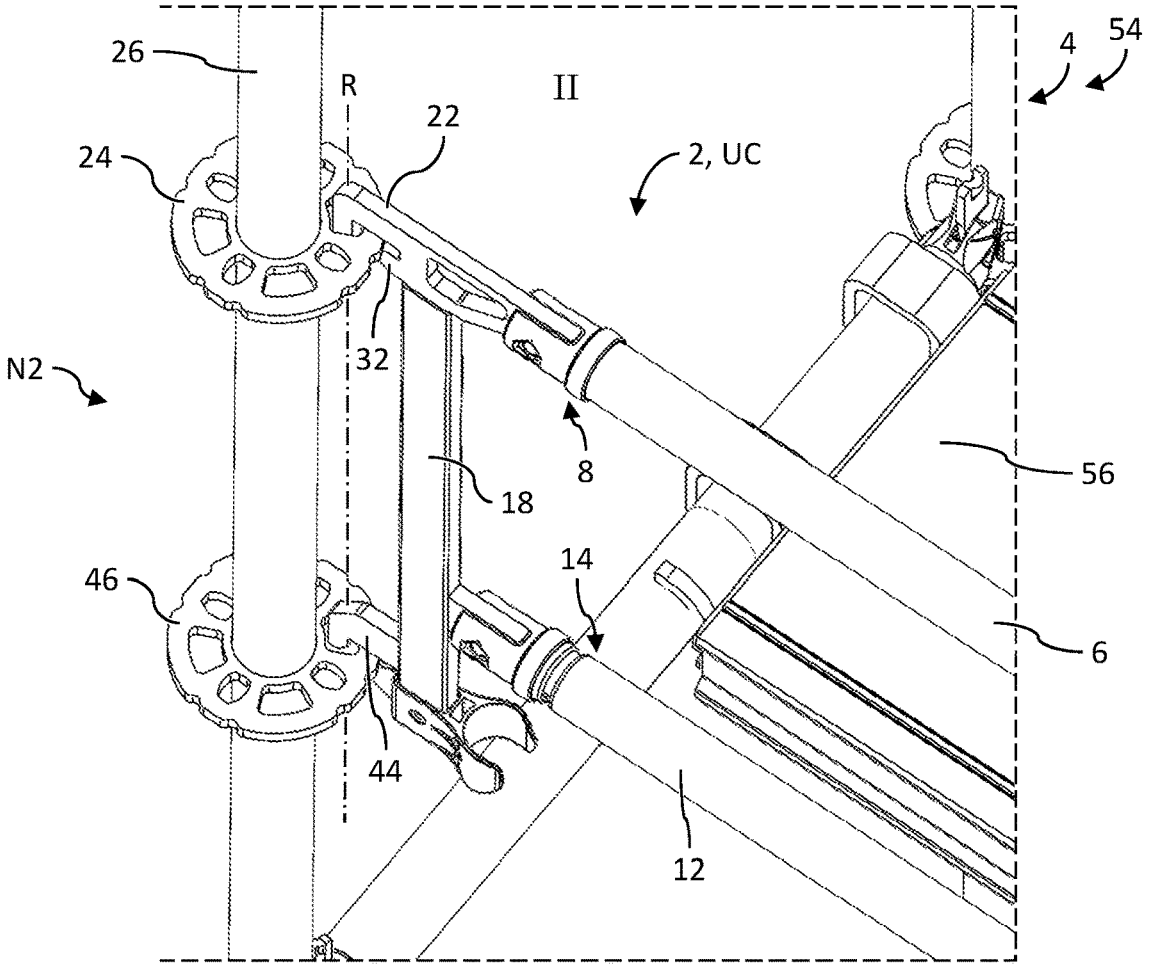
FIG. 3A shows an oblique top view of the combination of FIGS. 2A-B, wherein the coupling hook structure is in a second rotation position relative to the rosette.
Figure 3B:
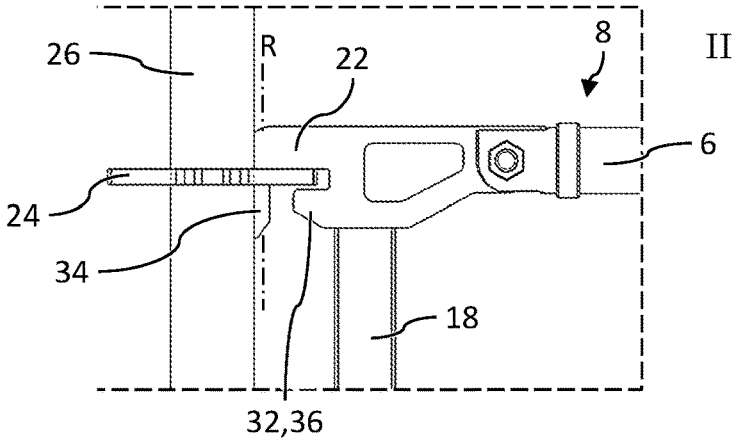
FIG. 3B shows a front view of a detail of the situation of FIG. 3A.
Figure 4A:
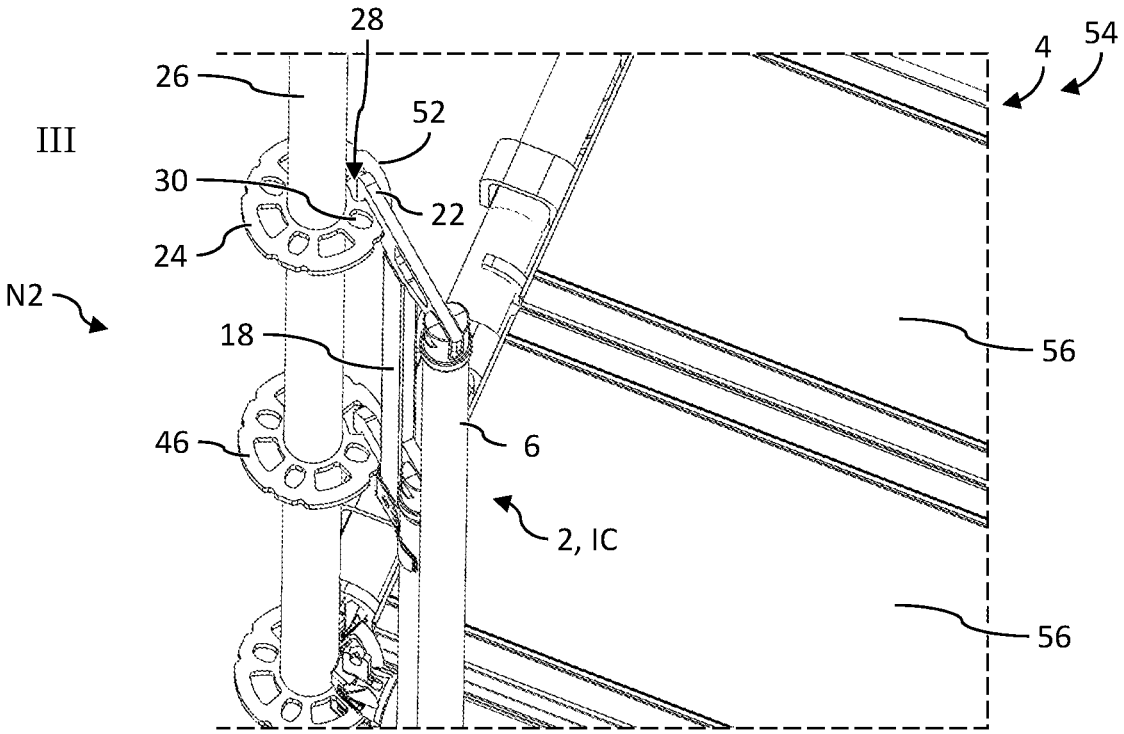
FIG. 4A shows an oblique top view of the combination of FIGS. 2A-3B, wherein the coupling hook structure is in a third rotation position relative to the rosette.
Figure 4B:
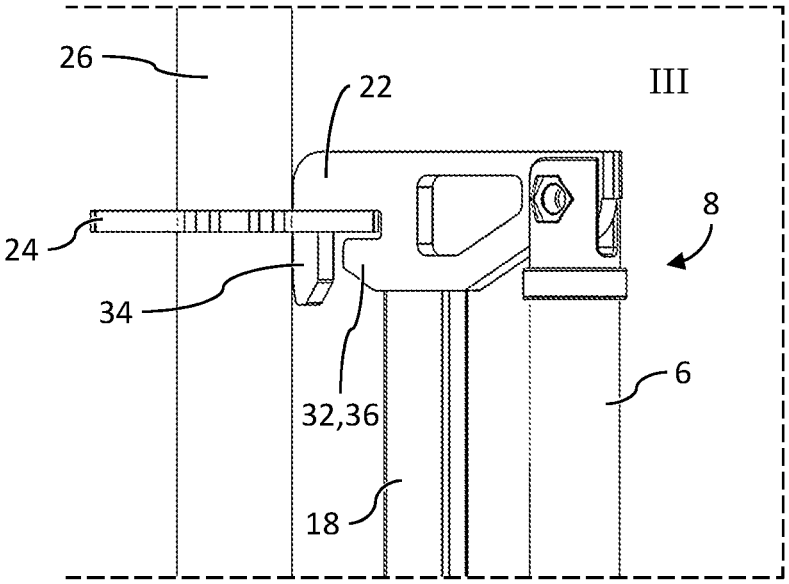
FIG. 4B shows a front view of a detail of the situation of FIG. 4A.
Figure 5A:
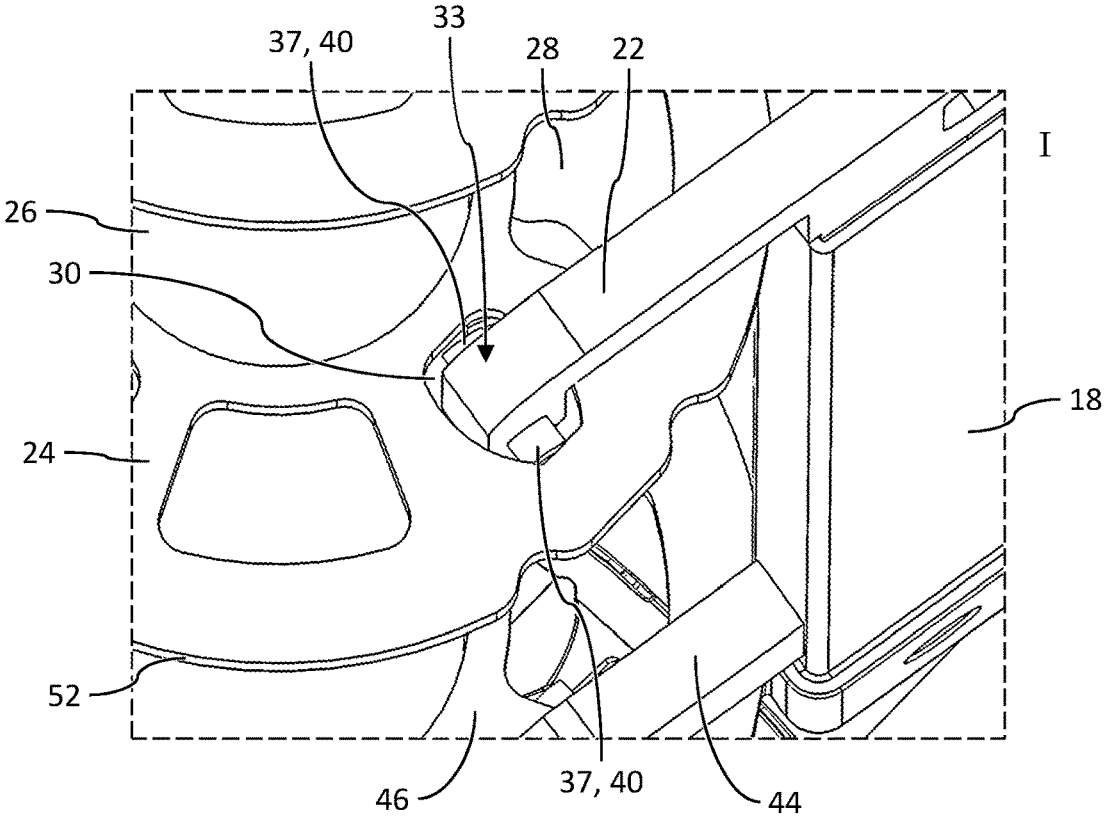
FIG. 5A shows an oblique top view of a combination of an example of a folding rail assembly according to a second embodiment and a standard of a scaffold, wherein a coupling hook structure of the assembly is in a first rotation position relative to a rosette of the standard.
Figure 5B:
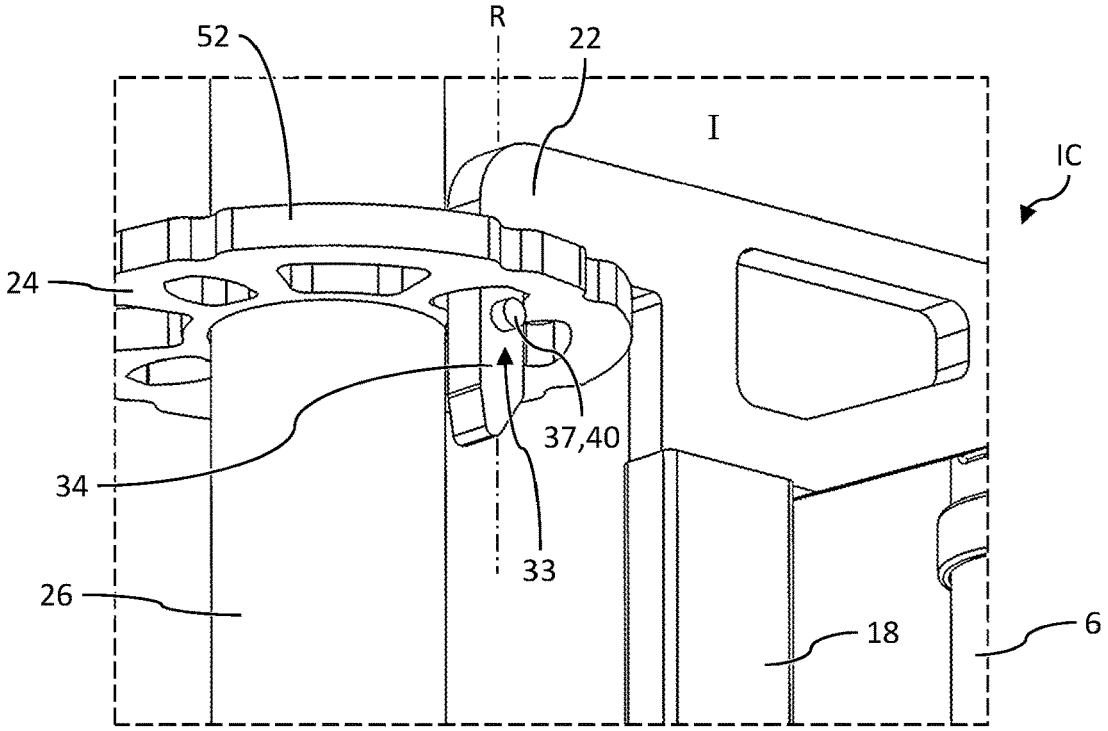
FIG. 5B shows an oblique bottom view of the situation of FIG. 5A.
Figure 6A:
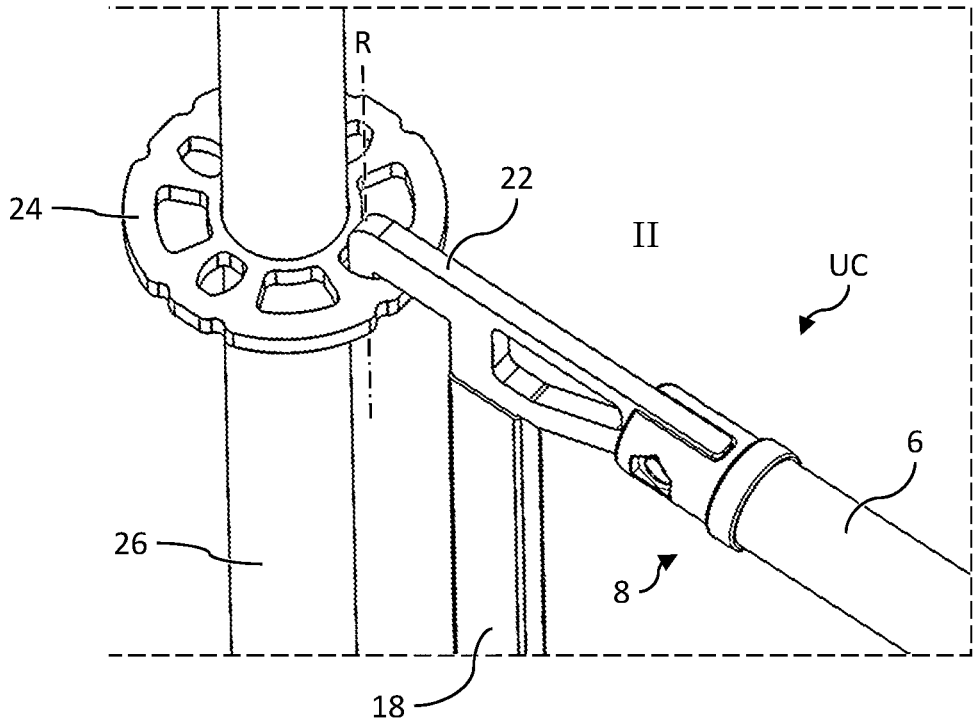
FIG. 6A shows an oblique top view of the combination of FIGS. 5A-B, wherein the coupling hook structure is in a second rotation position relative to the rosette.
Figure 6B:
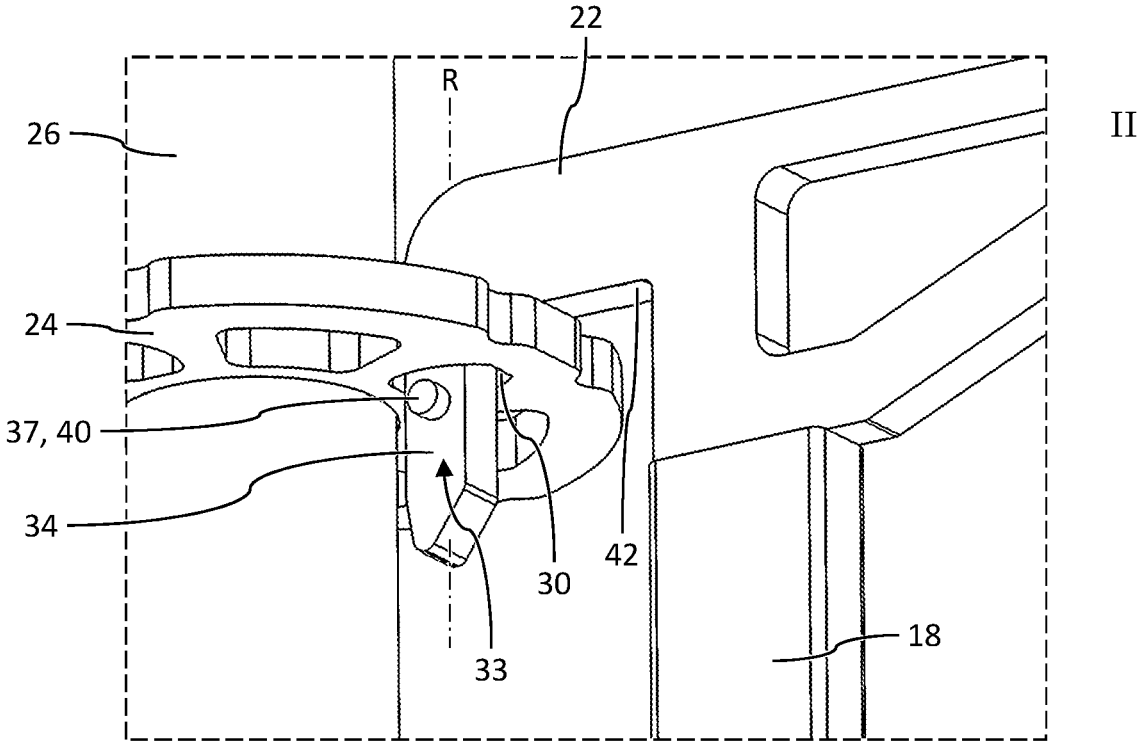
FIG. 6B shows an oblique bottom view of the situation of FIG. 6A.
Figure 7A:
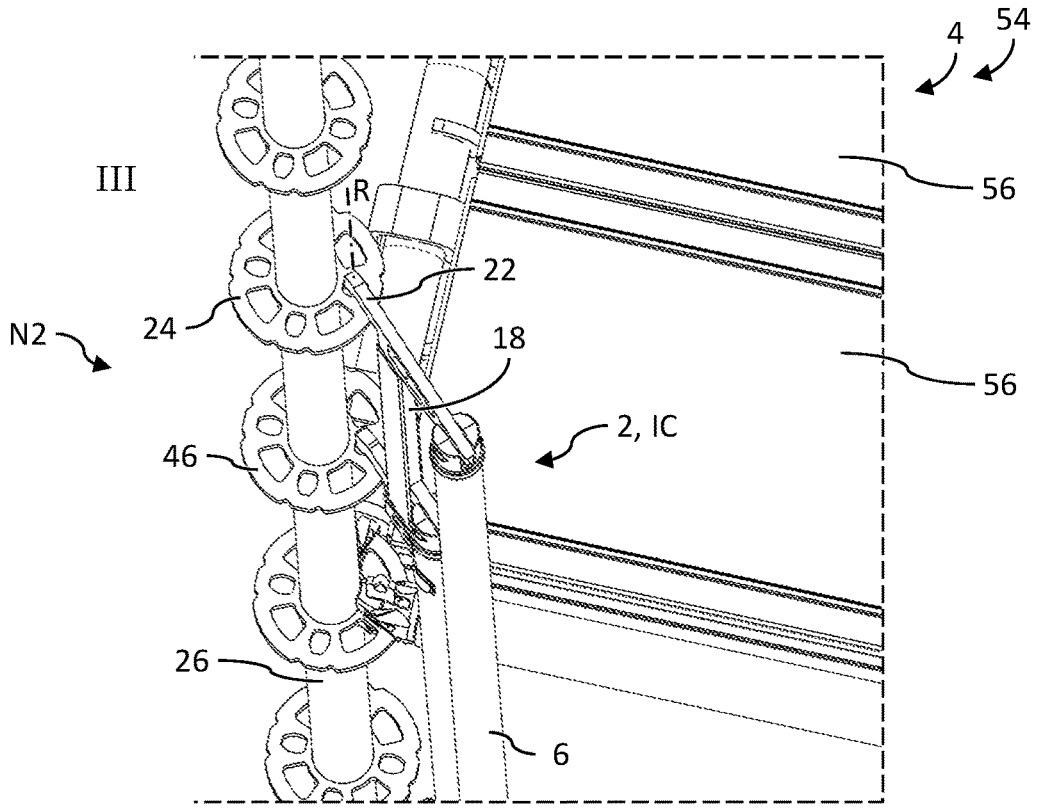
FIG. 7A shows an oblique top view of the combination of FIGS. 5A-6B, wherein the coupling hook structure is in a third rotation position relative to the rosette.
Figure 7B:
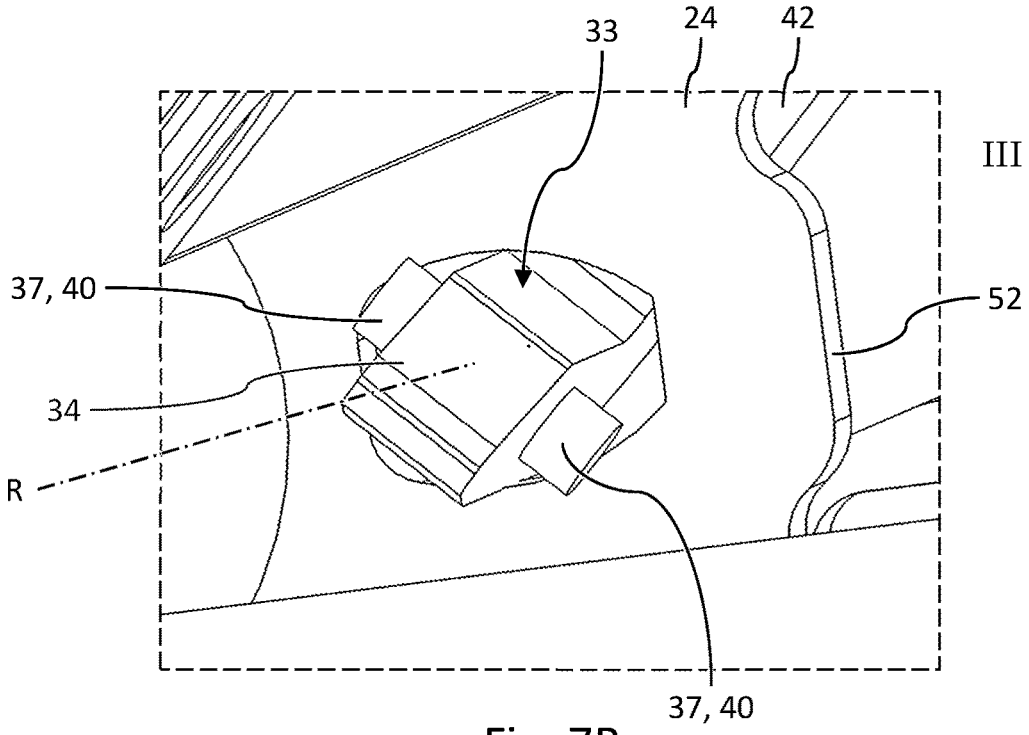
FIG. 7B shows an oblique bottom view of a detail of the situation of FIG. 7A.

As an example, in FIG. 2B, such an angle α of about 90 degrees is indicated between the first post 18, which here extends substantially vertically, and the hook end section 36, which here extends substantially horizontally from the first post, radially outwards. In the example of FIGS. 5A-7B, the above-mentioned angle α (not indicated there) is also about 90 degrees, with the hook end section 37 extending substantially normally with respect to a plane which is here defined by the first post 18 and the coupling hook structure 22.

In an embodiment, a hook end section 36 or 37 of the locking hook structure 32 or 33 and a hook end section 34 of the coupling hook structure 22 extend relative to each other at an angle β, the angle β being in the range of 45 through 135 degrees.

Such an angle β makes it possible that the hook end section 34 of the coupling hook structure 22 remains positioned in the rosette opening 28 or 30, in particular with necessary play, while the position of the hook end section 36 or 37 of the locking hook structure 32 or 33 can be adjusted as described between a release position and a locking position. In FIG. 2B, as an example, an angle β of about 90 degrees is indicated. In FIGS. 5A-7B it can be seen that the angle β (not indicated there) in that example is also about 90 degrees.

In an embodiment, the first post 18, the coupling hook structure 22 and the locking hook structure 32 or 33 are mutually fixed in a common fixed structure.

Thus a particularly robust and durable combined coupling structure of the rail assembly 2 can be provided.

In an embodiment, see for example FIGS. 2A-4-B, a hook end section 36 of the locking hook structure 32 extends radially outwards relative to the first post 18.

Such an embodiment can, in particular, be suitable for cooperation with a rosette opening 28 which is generally intended for diagonal scaffold connections.

It can be seen that in the first rotation position I the hook end section 36 remains outside the radial range of the rosette 24, while in the second II and third rotation position III the hook end section 36 extends to within the radial range of the rosette 24, so that the hook end section 36 is hooked under the rosette 24 so as to counteract moving up of the first post 18.

In such an embodiment, preferably, along the first post 18, between the coupling hook structure 22 and the locking hook structure 32, an intermediate space 38 is formed in which a part of the rosette 24 can be received for counteracting the moving up of the coupling hook structure 22.

Thus, a supporting surface 42 of the coupling hook structure 22 can be supported on an upper surface of the rosette 24 while the locking hook structure 32 extends along a bottom surface of the rosette 24.

In such an embodiment, the coupling hook structure 22 and the hook end section 36 of the locking hook structure 33 preferably extend substantially in a same plane. The coupling hook structure 22 and the locking hook structure 32 may thus, for instance, be formed from one planar piece. It will be clear that in that case, between the hook end section 36 of the locking hook structure 32 and the hook end section 34 of the coupling hook structure 22, also an intermediate space is provided, so that a part of the rosette 24 can move therethrough when the coupling hook structure 22 is suspended from the rosette 24.

In an embodiment, see for example FIGS. 5A-7B, a hook end section 37 of the locking hook structure 33 extends from a hook end section 34 of the coupling hook structure 22.

Such an embodiment can, in particular, be suitable for cooperation with a rosette opening 30 which is generally intended for right-angled scaffold connections, such as connections with ledgers for floor parts 56.

It can be seen that in the first rotation position I the hook end section 37 remains within the horizontal range of the opening 30, while in the second II and third rotation position III the hook end section 37 extends beyond the horizontal range of the opening 30, so that the hook end section 37 is hooked under the rosette 24 so as to counteract moving up of the first post 18.

In such an embodiment, the locking hook structure 33 is preferably substantially formed as an at least local widening, in particular thickening, 40 on the hook end section 34 of the coupling hook structure 22, which widening 40, viewed along the hook end section 34 of the coupling hook structure 22, is placed remote from a supporting surface 42 of the coupling hook structure 22, by which supporting surface 42 the coupling hook structure 22 in its suspended state is supported on the rosette 24. The widening or thickening 40 is for example pin- or stick-shaped.

In such an embodiment, the hook end section 37 of the locking hook structure 33 preferably extends outwards relative to a plane in which the coupling hook structure 22 substantially extends, preferably on both sides of the coupling hook structure 22.

Thus, a particularly good locking can be provided, while the hook end section 34 of the coupling hook structure 22 can extend centrally through the rosette opening 30.

The figures further show a combination of the folding rail assembly 2 and a standard 26 for a scaffold 4, which standard 26 is provided with a rosette 24 having an opening 28 and/or 30 for receiving the coupling hook structure 22 therein with play. The standard 26 with rosette 24 can be of a type known per se. The play concerns in particular rotational play around the rotation axis R mentioned.

In an embodiment, a distance between the opening 28 and/or 30 and an outer edge 52 of the rosette 24 varies depending on a measuring direction in a plane transversal to a length direction of the standard 26.

Thus, a particularly effective locking by means of a first variant of the locking hook structure 32, for example as shown in FIGS. 2A-4B, is enabled.

In an embodiment, the opening 28 and/or 30 has a non-circular shape with a diameter which varies depending on a measuring direction in a plane transversal to a length direction of the standard 26.

Thus, a particularly effective locking by means of a second variant of the locking hook structure 33, for example as shown in FIGS. 5A-7B, is enabled.

The figures further show a scaffolding system 54 comprising the combination of the folding rail assembly 2 and the standard 26.

While the invention has been explained herein on the basis of examples of embodiments, these do not limit the scope of the invention as defined in the claims. On the basis of the present disclosure, a person skilled in the art will readily appreciate that many combinations, variations and extensions are possible which fall within the scope of the claims. For instance, a folding rail assembly may be free of any telescopably configured rail part. In that case, the mutually hinged posts and rail parts of the folding rail assembly can form a parallelogram construction. The variants of the locking hook structure shown as examples, or comparable variants, may be mutually combined.

The invention claimed is:

1. A folding rail assembly for a scaffold, comprising:

an upper rail part extending in a respective length direction between a respective first end and a respective second end;

a middle rail part extending in a respective length direction between a respective first end and a respective second end;

a first post hingedly connected with each of the respective first ends of the upper rail part and the middle rail part; and a second post hingedly connected with each of the respective second ends of the upper rail part and the middle rail part, wherein the folding rail assembly by means of hinging of the hingeable connections is adjustable between a folded-in configuration and a folded-out configuration, wherein the first post is provided with a coupling hook structure configured to suspend the first post from a rosette of a standard of the scaffold when the first post is positioned substantially parallel to the standard, wherein the coupling hook structure is configured to be received with play in an opening of the rosette so as, in a state suspended from the rosette, to be rotatable relative to the rosette, between at least a first rotation position and a second rotation position, around a rotation axis extending substantially parallel to the standard, and wherein the first post at the coupling hook structure is provided with a locking hook structure, wherein, in the second rotation position but not in the first rotation position, the locking hook structure is configured to block upward movement of the first post, out of the state suspended from the rosette.

2. The folding rail assembly according to claim 1, wherein a hook end section of the coupling hook structure extends substantially parallel to the length direction of the first post, wherein a hook end section of the locking hook structure extends at an angle $\alpha$ to the length direction of the first post, with the angle $\alpha$ being in the range of 45 through 135 degrees.

3. The folding rail assembly according to claim 1, wherein a hook end section of the locking hook structure and a hook end section of the coupling hook structure extend relative to each other at an angle $\beta$, with the angle $\beta$ being in the range of 45 through 135 degrees.

4. The folding rail assembly according to claim 1, wherein the first post, the coupling hook structure and the locking hook structure are mutually fixed in a common fixed structure.

5. The folding rail assembly according to claim 1, wherein a hook end section of the locking hook structure extends radially outwards relative to the first post.

6. The folding rail assembly according to claim 5, wherein along the first post, between the coupling hook structure and the locking hook structure, an intermediate space is formed in which a part of the rosette can be received for counteracting upward moving of the coupling hook structure.

7. The folding rail assembly according to claim 5, wherein the coupling hook structure and the hook end section of the locking hook structure extend substantially in a same plane.

8. The folding rail assembly according to claim 1, wherein a hook end section of the locking hook structure extends from a hook end section of the coupling hook structure.

9. The folding rail assembly according to claim 8, wherein the locking hook structure is substantially formed as an at least local widening on the hook end section of the coupling hook structure, which widening, viewed along the hook end section of the coupling hook structure, is placed at a distance from a supporting surface of the coupling hook structure, by which supporting surface the coupling hook structure in its suspended state is supported on the rosette.

10. The folding rail assembly according to claim 8, wherein the hook end section of the locking hook structure extends outwards relative to a plane in which the coupling hook structure substantially extends.

11. The folding rail assembly according to claim 1, wherein the first post is provided with a further coupling hook structure configured to couple the first post at a distance from the coupling hook structure to a further rosette of the standard.

12. The folding rail assembly according to claim 1, wherein at least one of the upper rail part and the middle rail part is telescopically arranged to be adjustable in its length.

13. The folding rail assembly according to claim 1, wherein the rail assembly at the second post is provided with a coupling means for, after suspending of the first post, coupling the second post to a further standard of the scaffold so as to fix the rail assembly substantially in its folded-out configuration to the scaffold.

14. A combination of the folding rail assembly according to claim 1 and a standard for a scaffold, which standard is provided with a rosette with an opening for therein receiving the coupling hook structure with play.

15. The combination according to claim 14, wherein a distance between the opening and an outer edge of the rosette varies depending on a measuring direction in a plane transversal to a length direction of the standard.

16. The combination according to claim 14, wherein the opening has a non-circular shape with a diameter that varies depending on a measuring direction in a plane transversal to a length direction of the standard.

17. A scaffolding system comprising the combination according to claim 14.

18. A method for fastening a rail assembly to a scaffold comprising a standard provided with a rosette, the method comprising:

providing a folding rail assembly according to claim 1;

hooking the coupling hook structure into an opening of the rosette of the standard while the first post is positioned substantially parallel to the standard, as a result of which the first post is suspended from the rosette;

rotating the coupling hook structure relative to the rosette from the first rotation position to the second rotation position around the rotation axis extending substantially parallel to the standard, resulting in the locking hook structure blocking upward movement of the first post, out of the state suspended from the rosette; and at a distance from the standard, additionally coupling the folding rail assembly to the scaffold, resulting in further rotation of the coupling hook structure relative to the rosette around the rotation axis being counteracted.

19. The method according to claim 18, further comprising adjusting the folding rail assembly from the folded-in configuration to the folded-out configuration after suspending of the first post.

20. The method according to claim 19, wherein at least one of the upper rail part and the middle rail part is telescopically arranged to be adjustable in its length, and wherein adjusting from the folded-in configuration to the folded-out configuration comprises adjusting the telescopically configured at least one of the upper rail part and the middle rail part in length by telescoping.

* * * * *